United States Patent [19]

Heckel

[11] Patent Number: 4,975,024

[45] Date of Patent: Dec. 4, 1990

[54] COMPRESSOR CONTROL SYSTEM TO IMPROVE TURNDOWN AND REDUCE INCIDENTS OF SURGING

[75] Inventor: Bruce G. Heckel, Trafford, Pa.

[73] Assignee: Elliott Turbomachinery Co., Inc., Jeannette, Pa.

[21] Appl. No.: 351,800

[22] Filed: May 15, 1989

[51] Int. Cl.[5] ..... F04B 49/00

[52] U.S. Cl. ..... 417/20; 417/18; 417/53

[58] Field of Search ..... 417/18, 20, 22, 23, 417/26, 28, 42, 43, 45, 53

[56] References Cited

U.S. PATENT DOCUMENTS

| | | | |
|---|---|---|---|
| 3,276,674 | 10/1966 | Hens | 230/115 |
| 3,424,370 | 1/1969 | Law | 230/5 |
| 3,737,252 | 6/1973 | Pilarczyk et al. | 417/53 |
| 3,901,620 | 8/1975 | Boyce | 415/1 |
| 4,046,490 | 9/1977 | Rutshtein et al. | 417/28 |
| 4,102,604 | 7/1978 | Rutshtein et al. | 417/23 X |
| 4,142,838 | 3/1979 | Staroselsky | 417/20 |
| 4,164,035 | 8/1979 | Glennon et al. | 364/431 |
| 4,191,511 | 3/1980 | Stewart et al. | 417/18 |

*Primary Examiner*—John C. Fox

*Attorney, Agent, or Firm*—Webb, Burden, Ziesenheim & Webb

[57] ABSTRACT

A method and apparatus for regulating the operation of a compressor system including a compressor moving a gas from an intake conduit through a discharge conduit to a gas storage reservoir are disclosed. In accordance with the method, an unload valve in an unload conduit connected to the discharge conduit is initially fully closed and an inlet valve in the intake conduit is initially fully opened. Then the inlet valve is closed by an amount necessary to maintain the discharge pressure at a design pressure level and at a gas flow rate between the design flow level and a minimum flow level. When the gas flow rate drops below the minimum flow level, the inlet valve is maintained in its last position and the unload valve is opened by an amount necessary to maintain the discharge pressure below a first pressure level set higher than the design pressure level. If the unload valve remains open beyond a position set point for longer than a first predetermined period of time, the unload valve is fully opened and the inlet valve is fully closed. Then if the system pressure drops below a second pressure level lower than the design pressure, the control steps discussed above are repeated.

10 Claims, 4 Drawing Sheets

COMPRESSOR CONTROL SYSTEM TO IMPROVE TURNDOWN AND REDUCE INCIDENTS OF SURGING

BACKGROUND OF THE INVENTION

1. Field of the Invention

This invention relates generally to surge control for compressors and, more particularly, to reducing the incidents of surge and improving turndown in centrifugal compressors or the like used in compressed gas systems.

2. Description of the Prior Art

The use of centrifugal compressors and the like in gas compression systems is well known in a variety of areas. For example, centrifugal compressors have been used to supply compressed air to one or more reservoirs which, in turn, supply the air to a plant, factory or other facility which requires a steady supply of pressurized air for tools, equipment, and the like. Such systems are normally designed to maintain a particular volume flow of air at a particular pressure. This is often referred to as the design point for the system.

Such a system will operate without the need for any particular control arrangement as long as the demand of the user of the compressed air remains at or near the design flow. A problem develops when the demand of the plant fluctuates, particularly when the demand for the pressurized air drops below the design flow level. As the flow drops, the discharge pressure of the compressor will tend to rise and the system may quickly reach the surge level for the compressor. See, for example, U.S. Pat. No. 3,901,620 which discusses the problems and characteristics of compressor surge.

A variety of arrangements have been suggested for controlling compressor surge as shown, for example, by U.S. Pat. Nos. 3,276,674, 3,424,370, 3,737,252, 4,046,490, 4,142,838, and 4,164,035. In a typical arrangement, the air flowing into the compressor is controlled by an inlet or throttle valve; excess air discharged by the compressor, as the discharge pressure increases beyond a maximum level, can be blown off by an unload valve or the like. As the system demand for the compressed air decreases, which is reflected in a decrease in current in a motor controlling the compressor, the inlet valve is gradually closed (i.e., throttled) to keep the system operating near the design pressure. However, use of an inlet valve alone has certain limitations since the system will eventually reach the surge line at lower flows and cause the compressor to go into an undesirable surge. Therefore, another control mechanism is needed whenever the flow approaches a particular minimum flow level, which is spaced a safe distance away from the surge line.

In accordance with another known system, the inlet valve is gradually closed until it reaches the minimum safe level for flow; the inlet valve is then not closed any further but remains frozen at the last position. Further reductions in air flow, as detected by a decrease in compressor motor amps, will cause the compressor discharge pressure to increase. When the discharge pressure reaches a particular maximum level above the design pressure, the unload valve, which was fully closed before that point, is fully opened and the inlet valve is fully closed. Thereafter, the control system monitors the system pressure in the reservoir to see if it drops below a particular minimum level. If so, the inlet valve is totally opened and the unload valve is totally closed in order to bring the pressure in the reservoir back up to a desired minimum level. The practice of modulating the unload valve to help control surge is also recognized in the art.

However, these systems have a number of problems. In particular, they use a high rise in compressor discharge pressure to determine whether to use a control other than throttling of the inlet valve. A risk is present in such a system that the compressor will accidentally go into surge. In addition, the minimum flow rate before using the unload valve must be spaced a large distance away from the surge line at the design pressure level to insure that surge is not reached. In addition, the characteristic curves for the operating system must be relatively steep in order to insure that surge is not quickly reached with a slight drop in flow rate. Thus, the design criteria for the compressor system becomes very crucial and the designer is given little design leeway. In addition, since the minimum flow rate must be a large distance from the crossing of the surge line with the design pressure line, the use of the inlet valve to control surge, which is more energy efficient than the use of the unload valve, is more restricted than is really needed.

Therefore, it is an object of the present invention to obtain a greater turndown in the control system, namely, more use of the inlet valve to control the system and prevent surge. It is also an object of the present invention to minimize the use of the unload valve for controlling the system and preventing surge. It is a further object of the present invention to control surge in the system but at the same time to reduce the inefficiencies of unloading large amounts of air from a running compressor and to recognize certain extreme fluctuations in demands on the system flow to minimize needless and energy inefficient operation of the compressor.

SUMMARY OF THE INVENTION

Accordingly, I have invented a method of regulating the operation of a compressor system which includes a compressor moving a gas from an intake conduit through a discharge conduit to a gas storage reservoir, an inlet valve in the intake conduit, an unload conduit connected to the discharge conduit and an unload valve in the unload circuit. The compressor system also includes means for detecting the discharge pressure of the compressor, means for detecting the flow rate of gas from the compressor and means for detecting the system pressure in the reservoir. The method in accordance with my invention includes the steps of initially fully closing the unload valve and fully opening the unload valve, and then closing the unload valve by an amount necessary to maintain the discharge pressure at a constant design pressure level and at a gas flow rate between a design flow level and a minimum flow level. The method includes detecting when the gas flow rate reaches the minimum flow level and thereafter maintaining the inlet valve in its last position and opening the unload valve by an amount necessary to maintain the discharge pressure below a first pressure level set higher than the design pressure level.

The system monitors the position of the unload valve and measures the period of time that the unload valve remains open beyond a predetermined position set point. Then the system fully opens the unload valve and fully closes the inlet valve if the unload valve remains open beyond the position set point for longer than a first predetermined period of time. Thereafter, the system monitors the system pressure and compares the system pressure with a second pressure level lower than the design pressure. If the system pressure drops below the second pressure level, the control steps discussed above are repeated.

In a second embodiment of my invention, the inlet valve is initially fully opened and the unload valve is initially fully closed. The inlet valve is then closed by an amount necessary to maintain the discharge pressure at a constant design pressure level and to maintain the gas flow rate at a constant design flow level. The system detects when the discharge pressure reaches a first pressure level set higher than the design pressure level. Thereafter the inlet valve is maintained in its last position and the unload valve is opened by an amount necessary to maintain the discharge pressure below the first pressure level as the gas flow rate drops below the design flow level. The system monitors the position of the unload valve and measures the period of time that the unload valve remains open beyond a predetermined position set point. The system fully opens the unload valve and fully closes the inlet valve if the unload valve remains open beyond the position set point for longer than a first predetermined period of time. The system pressure is monitored and compared with a second pressure level lower than the design pressure. The control steps discussed above are repeated if the system pressure drops below the second pressure level.

The control method can also include in either embodiment the step of monitoring the period of time that the unload valve remains fully open when the inlet valve has been fully closed. If the unload valve remains fully open for longer than a second predetermined period of time, then further rotation of the compressor is stopped.

An apparatus implementing the methods discussed above are also disclosed in the application. The compressor system can include a motor driving the compressor and a current transmitter detecting current in the motor. The current transmitter can form the fluid flow detecting means. The discharge pressure detecting means can be a discharge pressure transmitter connected to the discharge conduit and the system pressure detecting means can be a system pressure transmitter connected to the reservoir.

DESCRIPTION OF THE PREFERRED EMBODIMENTS

Figure 1:
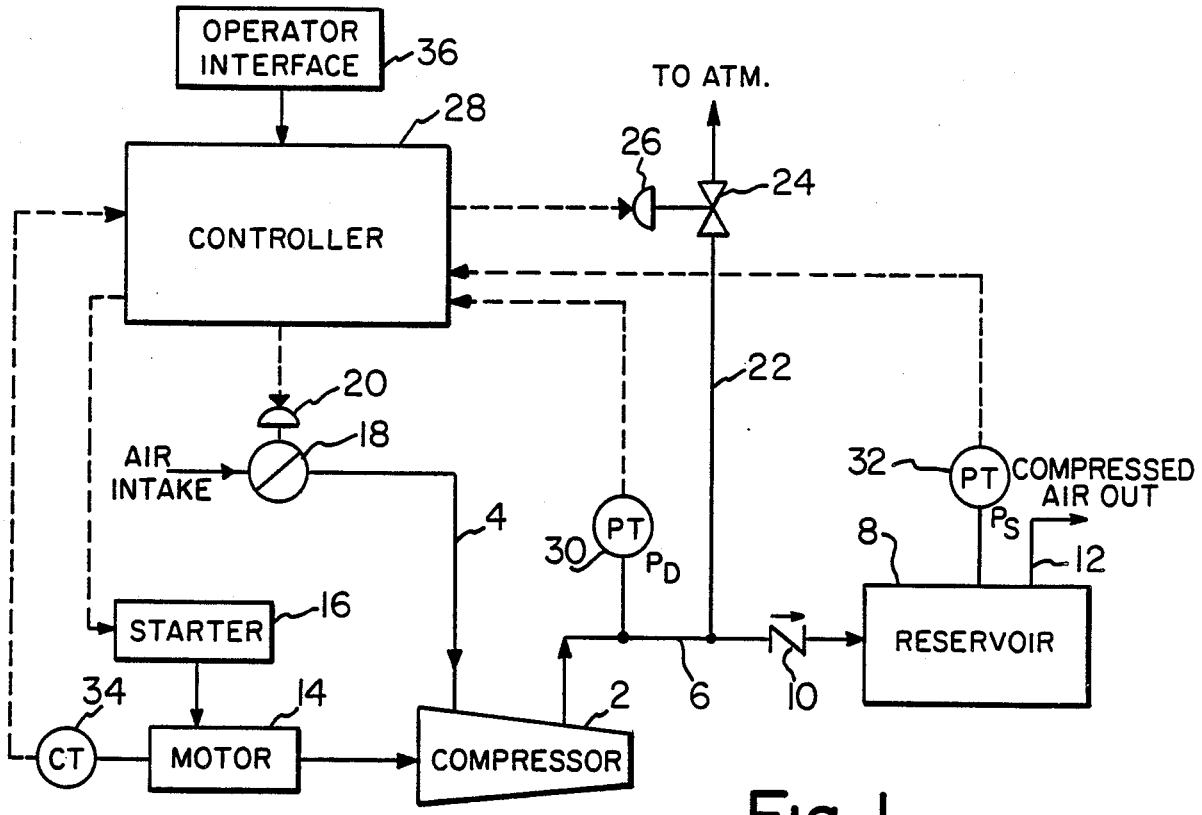
FIG. 1 is a block diagram of a compressor control system incorporating the present invention.

A system for supplying compressed air to a plant or the like and incorporating the control apparatus and method of the present invention is shown in FIG. 1. The arrangement includes a compressor 2, such as a multistage axial or centrifugal compressor, which has air supplied thereto through an intake conduit 4 and supplies compressed air through a discharge conduit 6 to a gas storage reservoir 8. A check valve 10 can be provided in the discharge conduit 6 to permit air flow only from the compressor 2 to the reservoir 8 and not in the opposite direction, as indicated by the arrow in FIG. 1. The compressed air is withdrawn from the reservoir 8 and supplied to a plant, factory or the like through an outlet conduit 12. The compressor 2 is rotated by a motor 14 which is controlled by a starter 16.

The air flow into the compressor 2 through the intake conduit 4 is controlled by an inlet or throttle valve 18 which is controlled by an inlet valve actuator 20. An unload conduit 22 is connected to the discharge conduit 6 and vents air from the compressor 2 to the atmosphere through an unload valve 24 controlled by an unload valve actuator 26. The inlet valve actuator 20, the unload valve actuator 26 and the starter 16 are all controlled by a controller 28 through appropriate electrical connections.

The discharge pressure from the compressor 2 is detected by a first pressure transmitter 30 and this pressure is supplied in the form of an electrical signal to the controller 28. In addition, the pressure in the reservoir 8, referred to as the system pressure, is detected by a second pressure transmitter 32 and this pressure is supplied in the form of an electrical signal to the controller 28. The current generated by the motor 14 is detected by a current transmitter 34 and the signal developed thereby is supplied in the form of an electrical signal to the controller 28. As described hereinafter in more detail, the pressure measured by the first pressure transmitter 30, the pressure measured by the second pressure transmitter 32 and the current measured by the current transmitter 34 are used by the controller 28, as dictated by instructions passed to the controller 28 through an operator interface 36, to control the operation of the inlet valve 18, the unload valve 24 and the motor 14 through the starter 16.

Figure 2:
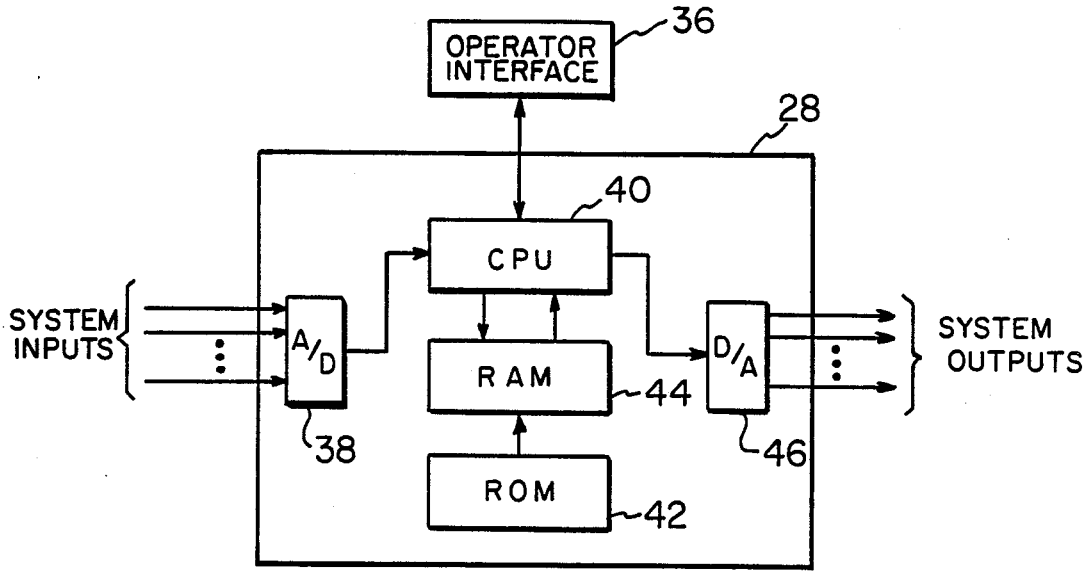
FIG. 2 is a block diagram of the controller shown in FIG. 1.

As shown in more detail in FIG. 2, the controller 28 shown in FIG. 1 is a microprocessor based controller, such as a commercially available Zycom controller which uses a Motorola 68010 processor. The controller 28 includes an integral analog to digital converter 38 which receives various system inputs, including the signals from the pressure transmitters 30 and 32 and the current transmitter 34. The incoming analog signals are converted to digital format and supplied to a central processing unit 40 in the controller 28. The controller 28 also includes a read only memory 42 which supplies a previously stored program to a random access memory 44. The random access memory 44 is connected to and has two-way communication with the central processing unit 40. The operator interface 36 is connected directly to the central processing unit 40 and is used to provide set points, command instructions and the like to the controller 28. The digital control signals developed by the central processing unit 40, as established by the program stored in the read only memory 42, by the system inputs and by the operator interface 36, are supplied to a digital to analog converter 46 which generates analog system outputs that are supplied to various components of the compressor system, including the starter 16, the inlet valve actuator 20 and the unload valve actuator 26, shown in FIG. 1.

In general, the algorithms used to control the compressor system are written in software format, such as in the C language for the Zycom controller, and burned into the read only memory 42. During operation of the system, the program from the read only memory 42 is loaded into the random access memory 44 for use by the central processing unit 40. While the general structure of the apparatus shown in FIGS. 1 and 2 is known in the art, the present invention relates to a particular method for controlling the operation of the motor 14, the inlet valve 18 and the unload valve 24 in accordance with parameters developed in the system during operation.

The method of operating the compressor system in accordance with the present invention is shown in the flow diagrams in FIGS. 3 and 4 and will be explained by additional reference to the compressor performance map in FIG. 5. Once the controller 28 has begun its operation at the start block 50, the operator must decide at the select mode block 51, by means of the operator interface 36, whether the system will be run under the auto dual mode beginning at block 52 or the intermittent mode beginning at block 53.

Under the auto dual mode at block 52, the unload valve 24 is initially fully closed, the inlet valve 18 is initially fully opened, and the compressor 2 is rotated at a normal operating speed by the motor 14. Air is pumped into the reservoir 8 by the compressor 2 and the system is operating at the design point comprising a particular design pressure and a particular design flow as reflected in a particular design motor amps developed in the motor 14. This is shown in FIG. 5 where the system is operating along curve A1 at the design point and well away from the surge line. The control system is now operating at block 54, the inlet valve control block, in the flow diagram shown in FIG. 3.

If the demand for the pressurized air from the reservoir 8 were to decrease, this would be reflected in an increase in the discharge pressure monitored by the first pressure transmitter 30. If the inlet valve 18 remained fully open, the discharge pressure would increase and the system would travel along curve A1 and eventually hit the surge line. To prevent this from happening and to keep the system operating at the desired design pressure while flows are decreasing, the inlet valve 18 is gradually closed or "throttled" to reduce the air intake to the compressor 2 and reduce the flow rate of air to the reservoir 8. This will cause the system to shift toward curve A2, for example. Since the system is designed to initially keep the discharge pressure at a particular level, the design pressure, curve A2 will intersect therewith at a lower flow rate as reflected in a lower motor amps level detected by the current transmitter 34. If the demand of the system continues to decrease, then the inlet valve 18 is further closed or throttled to keep the discharge pressure at the design level and move the system progressively from curve A2 to A3 and further toward the left along the design pressure line.

To make sure that the system does not, while throttling, hit the surge line, which crosses the design pressure at a lower flow rate, a particular flow rate or its equivalent motor amps level is selected as a minimum level beyond which further throttling by the inlet valve 18 will not be carried out.

When, the system does reach the minimum motor amps level, as detected by the controller 28 from the current transmitter 34, the inlet valve 18 will not be further closed and will be frozen in place. The system then moves to block 55 in FIG. 3 and uses the unload valve 24 as the surge control mechanism. Without the use of the unload valve 24, the system would travel up curve A4 toward the surge line as flows further dropped below the minimum level. But in accordance with this invention, the unload valve 24 is gradually opened to keep the discharge pressure from exceeding a first predetermined pressure level which is set slightly higher than the design pressure. For example, if the design pressure is set at 100 PSI, then the first pressure level may be selected at 101 or 102 PSI. Unload valve 24 is gradually opened to keep the discharge pressure below the first pressure level and insure that the system does not reach surge as the system flow drops below the minimum level reflected by the minimum motor amps level shown in FIG. 5.

Rather than just rely on continued closing of the inlet valve 18 and/or opening of the unload valve 24 to keep the system from reaching surge, which is wasteful of energy, the present invention looks for unusually long drops in air demands on the reservoir 8 by monitoring the position of the unload valve 24 for further control decisions. The system monitors the extent by which the unload valve 24 has been opened and how long it has remained open beyond a particular position. This can be readily carried out through the controller 28 because it will send an electrical signal to the unload valve actuator 26 to control the position of the unload valve 24. The controller 28 need only look at its own registers in the random access memory 44 to see how far the unload valve 24 was instructed to open. Internal clocks within the controller 28 can be used to determine how long the unload valve 24 has remained opened beyond a particular predetermined level. If the unload valve 24 remains open at or beyond the predetermined level, such as at 80% open, for longer than a predetermined length of time, such as 30 minutes, this will indicate that the decrease in demand on the reservoir 8 is more than ordinary. Extra steps will then be taken to avoid wasting energy in needlessly compressing air and unloading it through the unload conduit 22 and unload valve 24.

Figure 3:
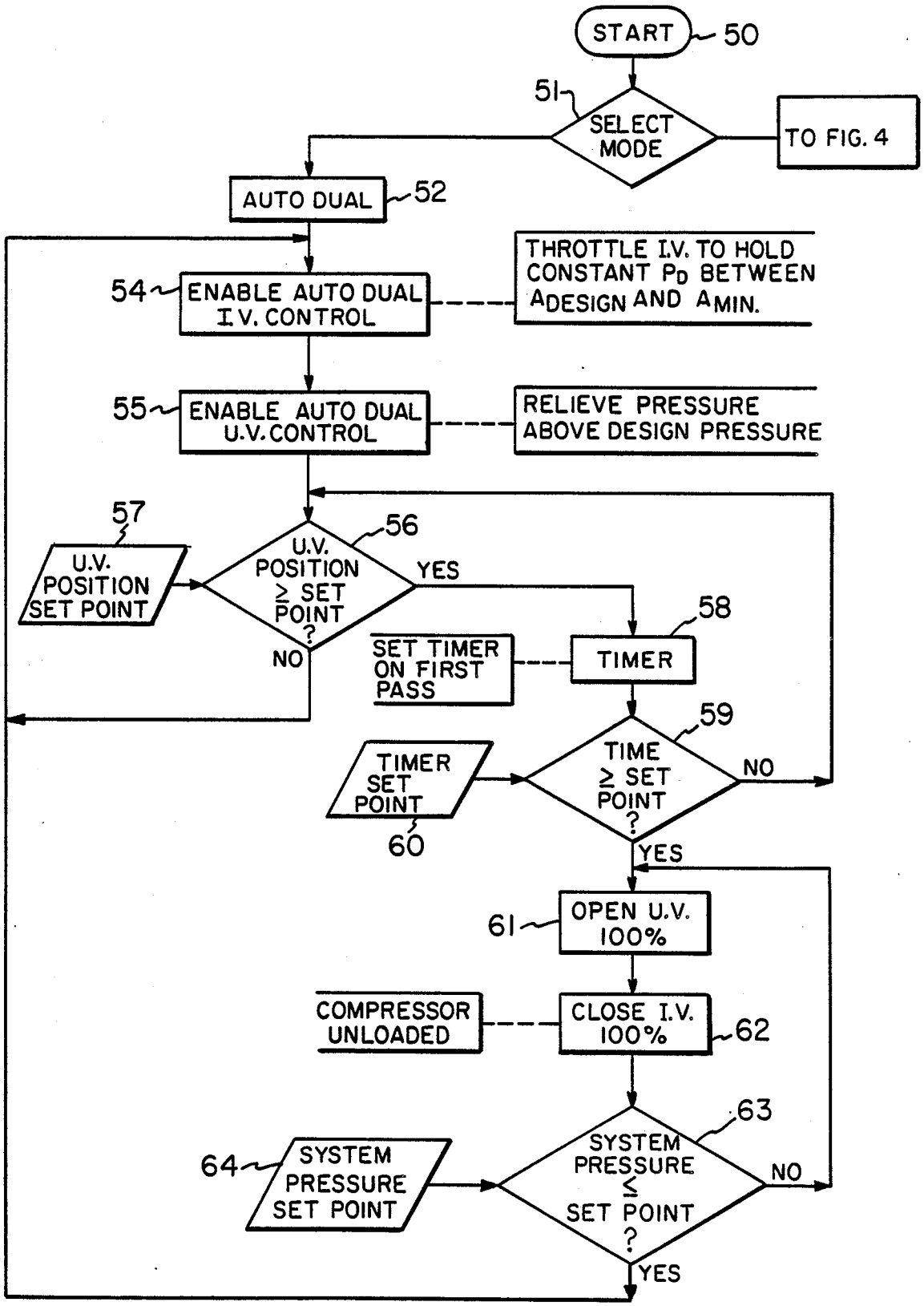
FIGS. 3 and 4 are flow charts showing the control program included in the controller shown in FIG. 3 and including the control method of the present invention.

As shown in FIG. 3, control of the program passes to block 56 where the position of the unload valve 24 is compared to an unload valve position set point established in block 57. This set point can be preprogrammed into the software or can be selected through the operator interface 36. If the position of the unload valve 24 remains below the set point in block 57, i.e., is not opened at or more than a certain amount, then control of the program returns to the beginning of the auto dual mode before block 54. If the position of the unload valve 24 is greater than or equal to the unload valve set point, then control passes to block 58 which initiates a timer on the first pass. The timer remains on while the unload valve 24 is at or beyond the unload valve position set point.

The system then passes control to block 59 which compares the time elapsed on the timer with a timer set point established in block 60. This set point, referred to as the first unload valve timer set point, can be preprogrammed into the software or can be selected through the operator interface 36. If the time elapsed in the timer in block 58 is less than the set point, then control is returned to block 56 for a further comparison of the position of the unload valve 24 with the unload valve position set point. If the time elapsed in the timer is greater than or equal to the timer set point, then control is passed to blocks 61 and 62. This occurs when the unload valve 24 has remained open at or beyond the unload valve set point level for a time equal to or exceeding the first unload valve timer set point, as set in block 60.

At blocks 61 and 62, the unload valve 24 is totally opened and then the inlet valve 18 is totally closed. At this stage, the compressor 2 is totally unloaded, no further air is being pumped into the reservoir 8 and the system is operating at curve B in FIG. 5. Thereafter, control is passed to block 63 which compares the system pressure, as measured by the second pressure transmitter 32, to make sure that the pressure in the reservoir 8 does not drop below a second pressure level set somewhat below the design pressure, such as 95 PSI. A system pressure set point, reflecting this second pressure level, is established in block 64 and can either be preprogrammed into the software or can be selected through the operator interface 36.

If the system pressure remains above the system pressure set point, then control returns above block 61 and the unload valve 24 remains opened and the inlet valve 18 remains closed. This indicates that the reservoir 8 has sufficient pressure to satisfy the needs of the plant, when the demand does increase and indicates that additional compressed air is not needed in the reservoir 8. If the system pressure drops to or below the system pressure set point, then control is returned to block 54 at the beginning of the auto dual control system. This later condition will indicate that air in the reservoir 8 has been withdrawn below a minimum level and needs to be supplemented. At that point, the unload valve 24 is totally closed, the inlet valve 18 is totally opened, and the control sequence discussed above is repeated from block 54.

If the system pressure remains above the system pressure set point, the compressor 2 will continue to rotate and pump air through the unload valve 24. It may be desirable to operate the compressor 2 in such a mode for only a limited period of time. According to an optional modification of FIG. 3, if the unload valve 24 remains at 100% open for more than a predetermined period of time, such as beyond 30 minutes, then the controller 36 can shut off the motor 14 by appropriately controlling the starter 16. This set of circumstances is indicative that the demand for air from the reservoir 8 has decreased and will remain low for a longer period of time. At that point, it is clear that the motor 14 need not continue to rotate the compressor 2 and needlessly waste energy. If the system pressure should thereafter drop below the set point, which is indicative that the demand for the pressurized air has resumed, then the compressor 2 will be once again rotated by the motor 14 and the control steps described above starting at block 52 will be repeated. This optional modification can be implemented in the block diagram in FIG. 3 by including an additional timer block, timer set point block and timer comparator block, similar to the arrangement in blocks 58–60, in the "no" line from block 63, with an additional block indicative that the motor 14 has been shut down when the timer set point has been reached or exceeded. The timer set point for this modification, referred to as the second unload valve timer set point can be preprogrammed into the software or can be selected through the operator interface 36.

Figure 4:
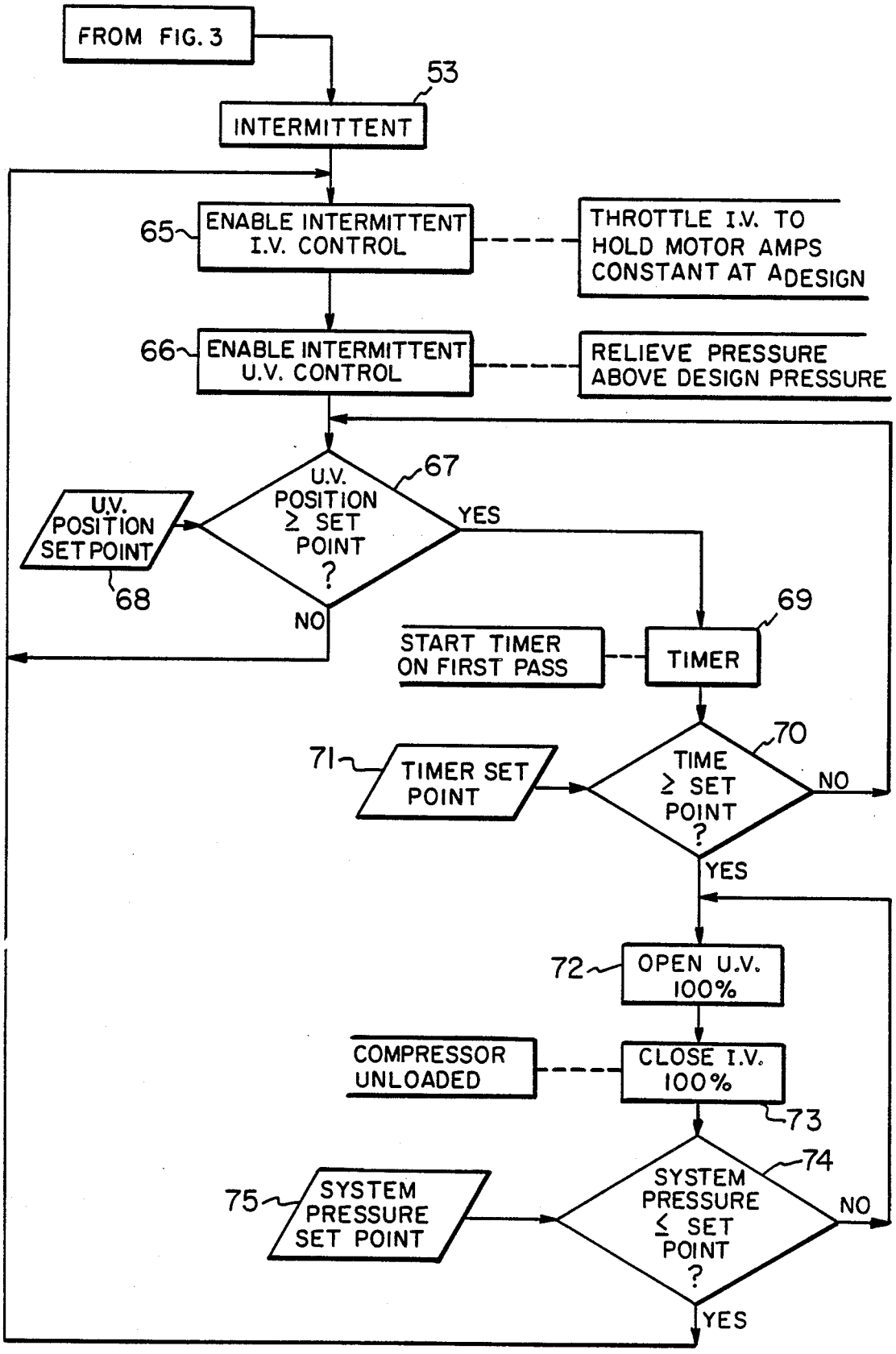
Figure 5:
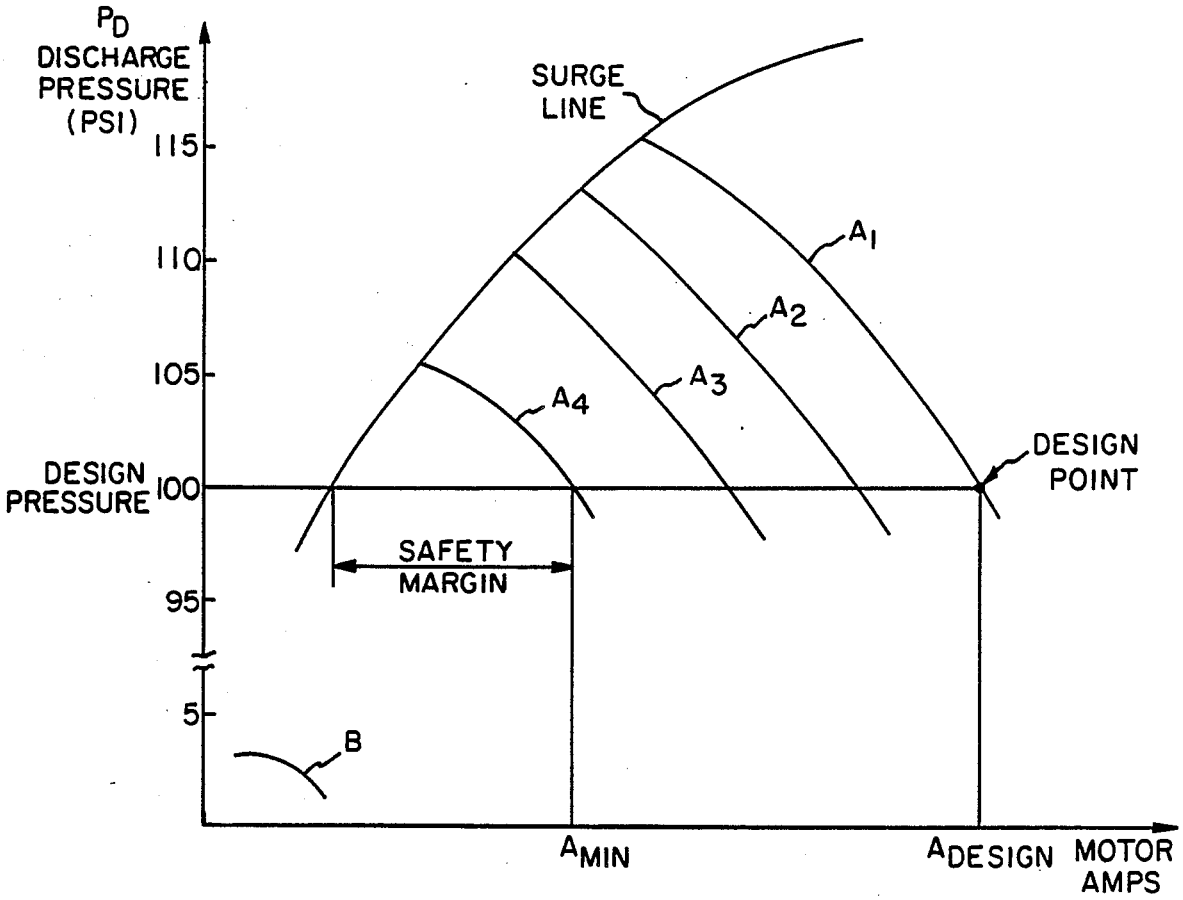
FIG. 5 is a compressor performance map for the system shown in FIG. 1.

The intermittent mode of operation is shown in FIG. 4. Similar to the auto dual mode, the inlet valve 18 is initially fully opened and the unload valve 24 is fully closed. However, the inlet valve 18 will be throttled or gradually closed at block 65 to keep the compressor 2 operating at the design point for both the design pressure and the design flow rate as measured by the design motor amps. In the program, the minimum motor amps level is equated to the design motor amps level. Eventually, further throttling of the inlet valve 18 will not keep the system at the design point and control is passed to block 66. At this point, the discharge pressure is continually monitored and the unload valve 24 is gradually opened to keep the discharge pressure from exceeding the first pressure level discussed above. Thereafter, the software operates through blocks 67–75 in a manner identical to the operation of blocks 56–64 discussed above in connection with FIG. 3 and the auto dual mode, including the optional modification regarding shutting down of the compressor 2.

The present arrangement has a number of advantages over prior art systems for controlling compressors and preventing surge. The system does not rely upon a high rise in discharge pressure to determine when the system should be unloaded through the unload valve. The position of the unload valve is detected directly by control signals already developed in the controller and this is used to control further operation of the unload valve. Since the system does not rely upon a high rise in discharge pressure for control purposes, the minimum flow rate can be moved closer to the surge line. As a result, the invention allows for greater turndown, namely, the use of the inlet valve to control the system. In addition, the system minimizes the use of the unload valve to prevent surge and makes a significant savings of energy. Moreover, the performance curves do not have to be as steep since the system will not unexpectedly reach surge from a sudden rise in discharge pressure. The options available to a designer for such a compressor system are greatly enhanced since arrangements having other curve characteristics can be used.

While it is preferred that the control arrangements be embodied within a programmed microprocessor controller, it is clear that other structures can be employed, such as an electrical controller formed of discrete elements, a pneumatic controller, or other known controllers. The present invention is directed to the methods employed for controlling the various components of the compressor system, irrespective of the particular control apparatus used to implement the methods.

Having thus described the preferred embodiments of the present invention, it is to be understood that the present invention may be otherwise embodied within the scope of the appended claims.

I claim:

1. A method of regulating the operation of a compressor system including a compressor moving a gas from an intake conduit through a discharge conduit to a gas storage reservoir, an inlet valve in said intake conduit, an unload conduit connected to said discharge conduit, an unload valve in said unload conduit, means for detecting the discharge pressure of said compressor, means for detecting the flow rate of gas from said compressor and means for detecting the system pressure in said reservoir, said method comprising the steps of:

(a) initially fully closing the unload valve and fully opening the inlet valve;

(b) closing the inlet valve by an amount necessary to maintain the discharge pressure at a constant design pressure level and at a gas flow rate between a design flow level and a minimum flow level;

(c) detecting when said gas flow rate reaches said minimum flow level;

(d) thereafter maintaining the inlet valve in its last position and opening the unload valve by an amount necessary to maintain the discharge pressure below a first pressure level set higher than said design pressure level;

(e) monitoring the position of the unload valve and measuring the period of time that the unload valve remains open beyond a predetermined position set point;

(f) fully opening the unload valve and fully closing the inlet valve if the unload valve remains open beyond the position set point for longer than a first predetermined period of time;

(g) monitoring the system pressure and comparing said system pressure with a second pressure level lower than said design pressure level; and (h) repeating steps a–g if the system pressure drops below said second pressure level.

2. The method of claim 1 further including between steps (g) and (h) the step of monitoring the period of time that the unload valve remains fully open in step (f) and stopping further rotation of said compressor if the unload valve remains fully open for longer than a second predetermined period of time.

3. The method of claim 1 wherein said compressor system includes a motor driving the compressor and a current transmitter detecting current in said motor, with said current transmitter forming said fluid flow detecting means.

4. The method of claim 1 wherein said discharge pressure detecting means is a discharge pressure transmitter connected to said discharge conduit.

5. The method of claim 1 wherein said system pressure detecting means is a system pressure transmitter connected to said reservoir.

6. An apparatus for regulating the operation of a compressor system including a compressor moving a gas from an intake conduit through a discharge conduit to a gas storage reservoir, an inlet valve in said intake conduit, an unload conduit connected to said discharge conduit, an unload valve in said unload conduit, means for detecting the discharge pressure of said compressor, means for detecting the flow rate of gas from said compressor and means for detecting the system pressure in said reservoir, said apparatus comprising:

(a) means for initially fully closing the unload valve and fully opening the inlet valve;

(b) means for closing the inlet valve by an amount necessary to maintain the discharge pressure at a constant design pressure level and at a gas flow rate between a design flow level and a minimum flow level;

(c) means for detecting when said gas flow rate reaches said minimum flow level;

(d) means for maintaining the inlet valve in its last position and opening the unload valve by an amount necessary to maintain the discharge pressure below a first pressure level set higher than said design pressure level;

(e) means for monitoring the position of the unload valve and measuring the period of time that the unload valve remains open beyond a predetermined position set point;

(f) means for fully opening the unload valve and fully closing the inlet valve if the unload valve remains open beyond the position set point for longer than a first predetermined period of time;

(g) means for monitoring the system pressure and comparing said system pressure with a second pressure level lower than said design pressure level; and (h) means for detecting if the system pressure drops below said second pressure level.

7. The apparatus of claim 6 further including means for monitoring the period of time that the unload valve remains fully open and stopping further rotation of said compressor if the unload valve remains fully open for longer than a second predetermined period of time.

8. The apparatus of claim 6 wherein said compressor system includes a motor driving the compressor and a current transmitter detecting current in said motor, with said current transmitter forming said fluid flow detecting means.

9. The apparatus of claim 6 wherein said discharge pressure detecting means is a discharge pressure transmitter connected to said discharge conduit.

10. The apparatus of claim 6 wherein said system pressure detecting means is a system pressure transmitter connected to said reservoir.

* * * * *